US009821986B2

(12) United States Patent
Chen

(10) Patent No.: US 9,821,986 B2
(45) Date of Patent: Nov. 21, 2017

(54) VEHICLE WHEEL WITH SELF-RESCUE APPARATUS

(71) Applicant: Lu Chuan Tung International Co., Ltd., Tainan (TW)

(72) Inventor: Fei-Che Chen, Tianzhong Township (TW)

(73) Assignee: Lu Chuan Tung International Co., Ltd., Tainan (TW)

( * ) Notice: Subject to any disclaimer, the term of this patent is extended or adjusted under 35 U.S.C. 154(b) by 149 days.

(21) Appl. No.: 14/862,244

(22) Filed: Sep. 23, 2015

(65) Prior Publication Data

US 2017/0081157 A1 Mar. 23, 2017

(51) Int. Cl.
*B66D 1/60* (2006.01)
*B66D 1/00* (2006.01)

(52) U.S. Cl.
CPC ..... *B66D 1/005* (2013.01)

(58) Field of Classification Search
CPC ..... B66D 1/005; B66D 1/60
USPC ..... 242/392
See application file for complete search history.

(56) References Cited

U.S. PATENT DOCUMENTS 3,132,823 A * 5/1964 Domines ..... B66D 1/005 242/392
4,568,036 A * 2/1986 Kearney ..... B66D 1/005 242/392
4,767,081 A * 8/1988 Lau ..... B66D 1/005 242/392
4,778,126 A * 10/1988 Spann, Jr. ..... B66D 1/36 180/7.5
4,836,466 A * 6/1989 Peterson ..... B66D 1/005 242/392
5,115,994 A * 5/1992 Hershberger ..... B66D 1/005 242/392
6,375,110 B1 * 4/2002 Ofer ..... B66D 1/005 242/392
2003/0047725 A1 * 3/2003 Borgoglio ..... B66D 1/005 254/213
2009/0236576 A1 * 9/2009 Chou ..... B66D 1/005 254/323

* cited by examiner

*Primary Examiner* — Sang Kim
(74) *Attorney, Agent, or Firm* — Alan D. Kamrath; Kamrath IP Lawfirm, P.A.

(57) ABSTRACT

A vehicle wheel with self-rescue apparatus contains: a connecting disc and a winch device. The connecting disc includes a body, a protruded column, elongated locking orifices, fitting sleeves, through orifice, connection stems, and multiple fixing plates. Each locking orifice locks with each of plural nuts, and each connection stem has a tab and a threaded section for screwing with a screwing orifice on each fixing plate via one of the through orifices, and each fixing plate contacts with the wheel rim, after the threaded section screws with the screwing orifice via the one through orifice. The winch device includes a rolling disc, the accommodating opening, a passing opening, a cable, and a hooking portion. The rolling disc has the accommodating opening, and a profile of the accommodating opening corresponds to the protruded column, the rolling disc has the cable rolled thereon, and the cable has the hooking portion arranged thereon.

6 Claims, 8 Drawing Sheets

VEHICLE WHEEL WITH SELF-RESCUE APPARATUS

FIELD OF THE INVENTION

The present invention relates to a vehicle wheel with a self-rescue apparatus which pulls a tire out of muds, sands, or a cave when the tire is trapped.

BACKGROUND OF THE INVENTION

A conventional winch for various vehicle wheels is adapted to pull a tire out of muds, sands, or cave when the tire is trapped. The winch contains a body, a protective pad, a first anchor, and a second anchor, wherein the body has a connecting disc on which a cable is rolled, and the cable has a hook fixed on a distal end thereof. The connecting disc has a plurality of fixing orifices fitted with a plurality of coupling rods of a wheel rim, and the connecting disc is in connection with the wheel rim by using a plurality of nuts. When the tire is trapped in muds, sands, or a cave, the winch is mounted on the wheel rim of the tire in the muds, sands, or cave, the cable contacts with the protective pad, and the hook of the cable hooks with the first anchor or the second anchor, thereafter the first anchor or the second anchor is positioned, such that when the tire rotates, it drives the winch to roll the cable, thus pulling the tire out of the muds, sands, and cave.

However, the plurality of fixing orifices only fit with the plurality of coupling rods of the wheel rim, when the plurality of coupling rods protrude outwardly, thus liming using requirement.

The present invention has arisen to mitigate and/or obviate the afore-described disadvantages.

SUMMARY OF THE INVENTION

The primary objective of the present invention is to provide a vehicle wheel with a self-rescue apparatus which pulls a tire out of muds, sands, or a cave when the tire is trapped.

Another objective of the present invention is to provide a vehicle wheel with a self-rescue apparatus in which a body is fixed on a first side of a wheel rim securely by ways of a plurality of elongated locking orifices, fitting sleeves, nuts, through orifices and connection stems, and multiple fixing plates.

To obtain above-mentioned objectives, a vehicle wheel with a self-rescue apparatus provided by the present invention contains: a connecting disc mounted on a first side of a wheel rim of a tire. The connecting disc includes a body, a protruded column, a plurality of elongated locking orifices, a plurality of fitting sleeves, a plurality of through orifices, a plurality of connection stems, and multiple fixing plates.

The body has the protruded column extending outwardly from a central position thereof and formed in a polygon shape, the protruded column is inserted into an accommodating hole of the winch device, the plurality of elongated locking orifices are radially arranged on the body to lock with a plurality of nuts on the first side of the wheel rim, wherein each of the plurality of elongated locking orifices fits with one of the plurality of fitting sleeves, an outer wall of the one fitting sleeve retains with an inner wall of each elongated locking orifice, and an inner wall of the one fitting sleeve connects with each of the plurality of nuts on the first side of the wheel rim, such that the body is fixed on the first side of the wheel rim, the body has the plurality of through orifices annularly arranged thereon to insert the plurality of connection stems, and each connection stem has a tab formed on a first end thereof and has a threaded section surrounding a second end thereof so as to screw with a screwing orifice on each of the multiple fixing plates via one of the plurality of through orifices, and each fixing plate contacts with the wheel rim, after the threaded section of each connection stem screws with the screwing orifice of each fixing plate via the one through orifice.

The winch device includes a rolling disc, the accommodating opening, a passing opening, a cable, and a hooking portion. The rolling disc is formed in an I shape and has the accommodating opening passing through a central positioning thereof, wherein a profile of the accommodating opening corresponds to the protruded column, and the rolling disc has the cable rolled thereon, the cable has the hooking portion arranged thereon.

DETAILED DESCRIPTION OF THE PREFERRED EMBODIMENTS

Figure 1:
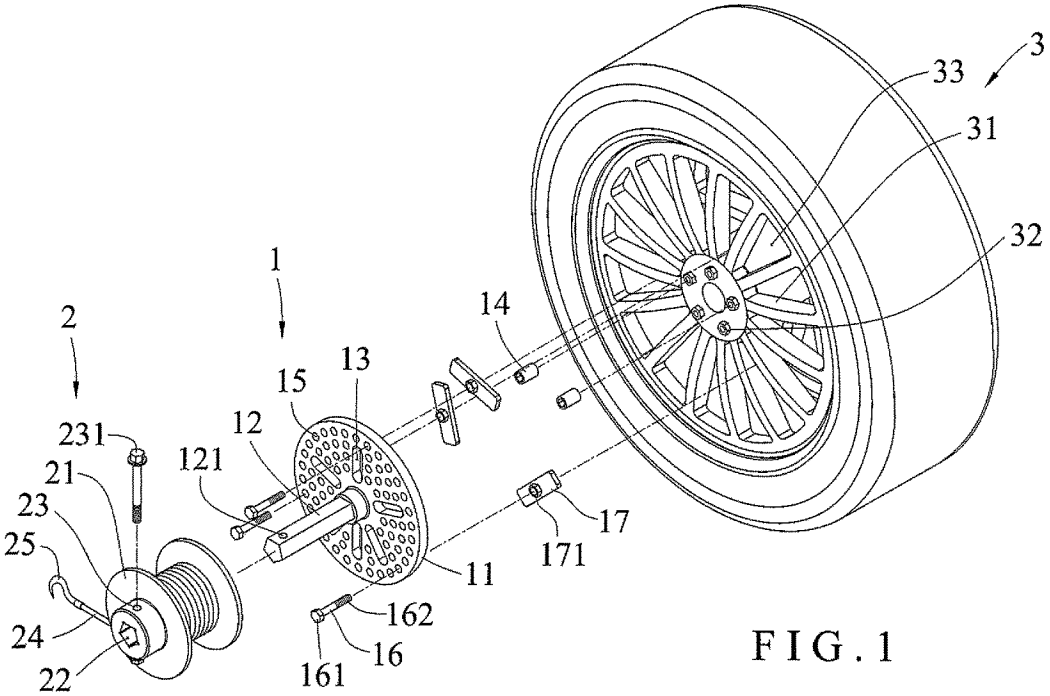
FIG. 1 is a perspective view showing the exploded components of a vehicle wheel with a self-rescue apparatus according to a first embodiment of the present invention.

Referring to FIG. 1, a vehicle wheel with a self-rescue apparatus according to a first embodiment of the present invention comprises: a connecting disc 1 and a winch device 2.

The connecting disc 1 is mounted on a first side of a wheel rim 31 of a tire 3, and the connecting disc 1 includes a body 11, a protruded column 12, a plurality of elongated locking orifices 13, a plurality of fitting sleeves 14, a plurality of through orifice 15, a plurality of connection stems 16, and multiple fixing plates 17.

The body 11 has the protruded column 12 extending outwardly from a central position thereof and formed in a polygon shape, the protruded column 12 has a pore 121 defined thereon and is inserted into an accommodating hole 22 of the winch device 2. The plurality of elongated locking orifices 13 are radially arranged on the body 11 to lock with a plurality of nuts 32 on the first side of the wheel rim 31, wherein each of the plurality of elongated locking orifices 13 fits with one of the plurality of fitting sleeves 14, such that an outer wall of the one fitting sleeve 14 retains with an inner wall of each elongated locking orifice 13, and an inner wall of the one fitting sleeve 14 connects with each of the plurality of nuts 32 on the first side of the wheel rim 31, hence the body 11 is fixed on the first side of the wheel rim 31. The body 11 has the plurality of through orifices 15 annularly arranged thereon to insert the plurality of connection stems 16, and each connection stem 16 has a tab 161 formed on a first end thereof to abut against the body 11, each connection stem 16 also has a threaded section 162 surrounding a second end thereof so as to screw with a screwing orifice 171 on each of the multiple fixing plates 17 via one of the plurality of through orifices 15, and each fixing plate 17 contacts with the wheel rim 3, after the threaded section 162 of each connection stem 16 screws with the screwing orifice 171 of each fixing plate 17 via the one through orifice 15.

The winch device 2 includes a rolling disc 21, the accommodating opening 22, a passing opening 23, a cable 24, and a hooking portion 25. The rolling disc 21 is formed in an I shape and has the accommodating opening 22 passing through a central positioning thereof, wherein a profile of the accommodating opening 22 corresponds to the protruded column 12 (i.e., the first opening 22 is polygonal), and the rolling disc 21 further has the passing opening 23 configured to accommodate a lock element 231 and communicating with the pore 121 and the accommodating opening 22, such that the lock element 231 inserts through the passing opening 23, the pore 121 and the accommodating opening 22 so as to fix the winch device 2 and the connecting disc 1 together. The rolling disc 21 further has the cable 24 rolled thereon, and the cable 24 is made of steel and has the hooking portion 25 arranged thereon.

Thereby, the each elongated locking orifice 13 of the connecting disc 1 locks with the first side of the wheel rim 31, and the protruded column 12 inserts into the accommodating opening 22 of the winch device 2.

Figure 2:
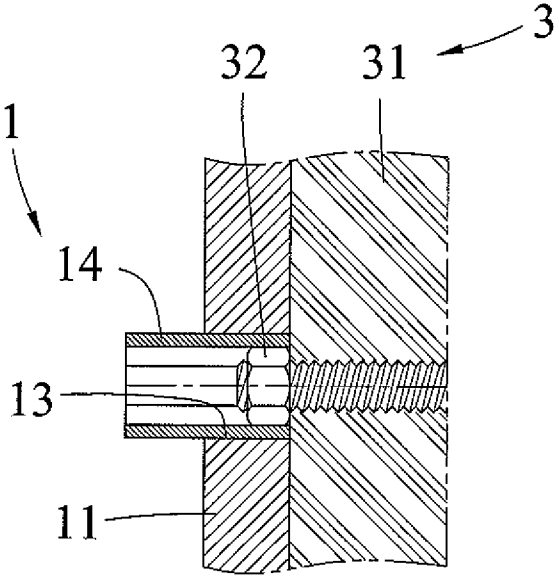
FIG. 2 is a cross sectional view showing the assembly of a part of the vehicle wheel with the self-rescue apparatus according to the first embodiment of the present invention.
Figure 3:
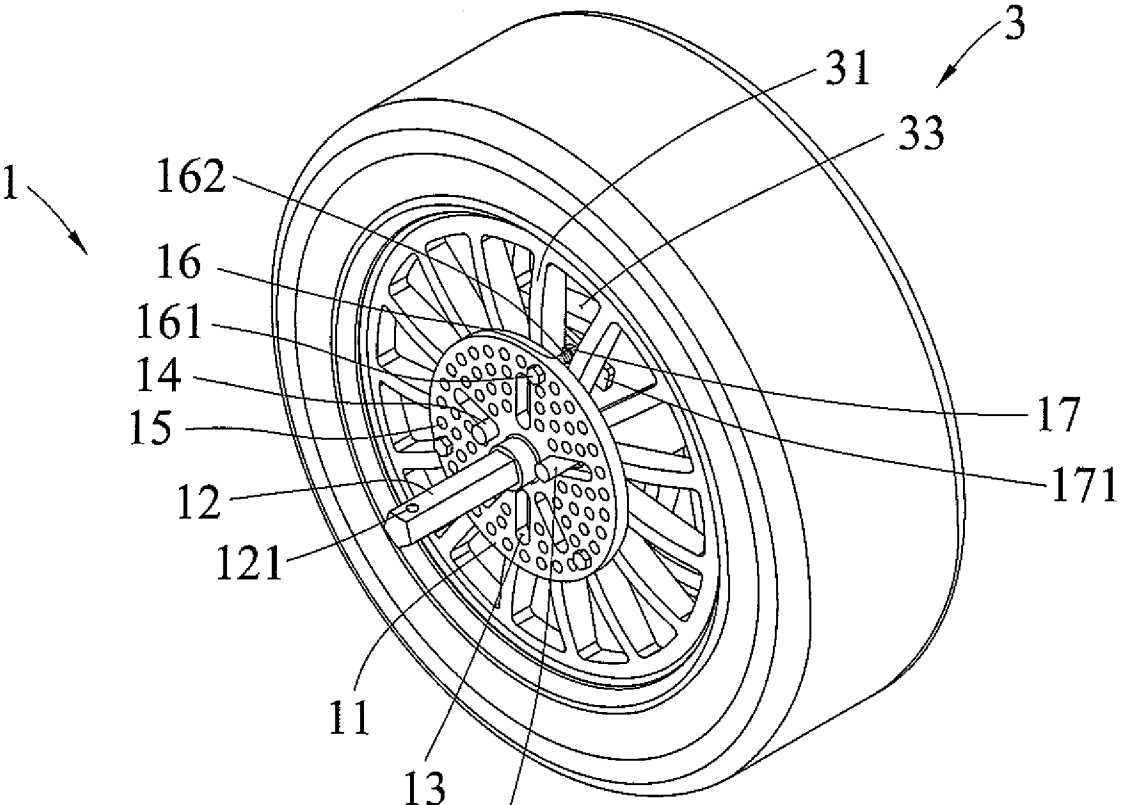
FIG. 3 is a perspective view showing the assembly of the vehicle wheel with the self-rescue apparatus according to the first embodiment of the present invention.
Figure 4:
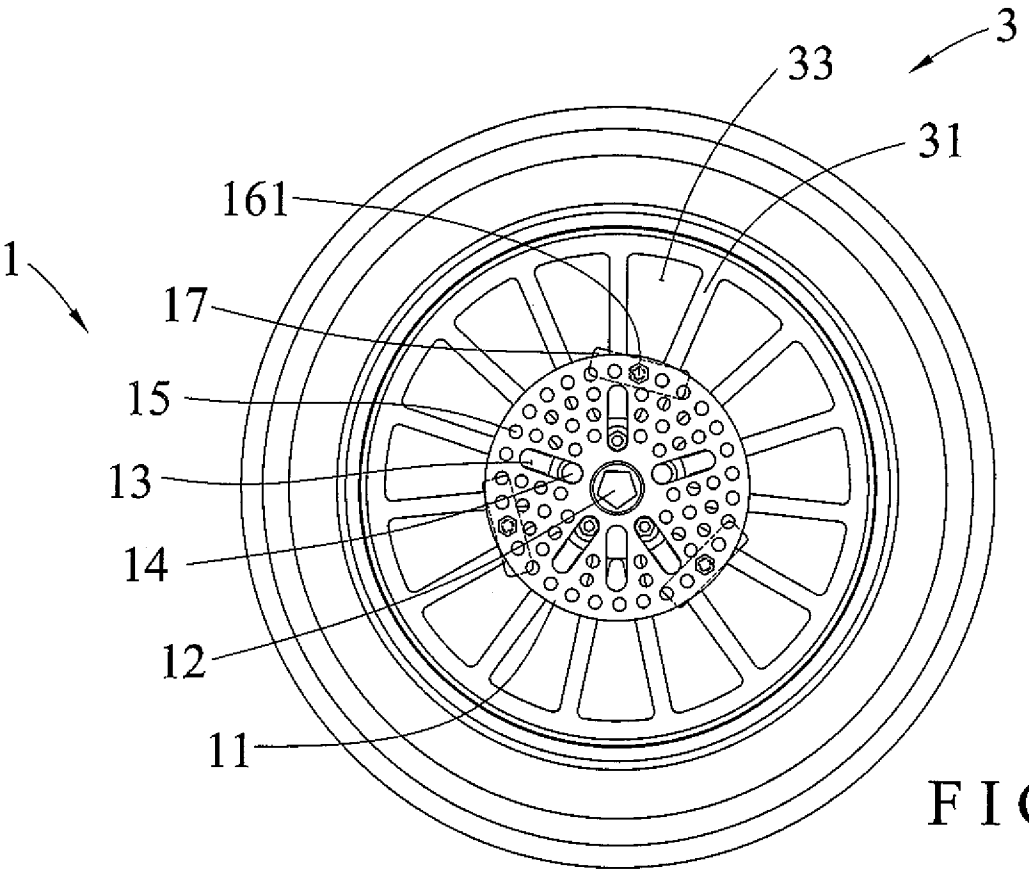
FIG. 4 is a side plane view showing the assembly of the vehicle wheel with the self-rescue apparatus according to the first embodiment of the present invention.
Figure 5:
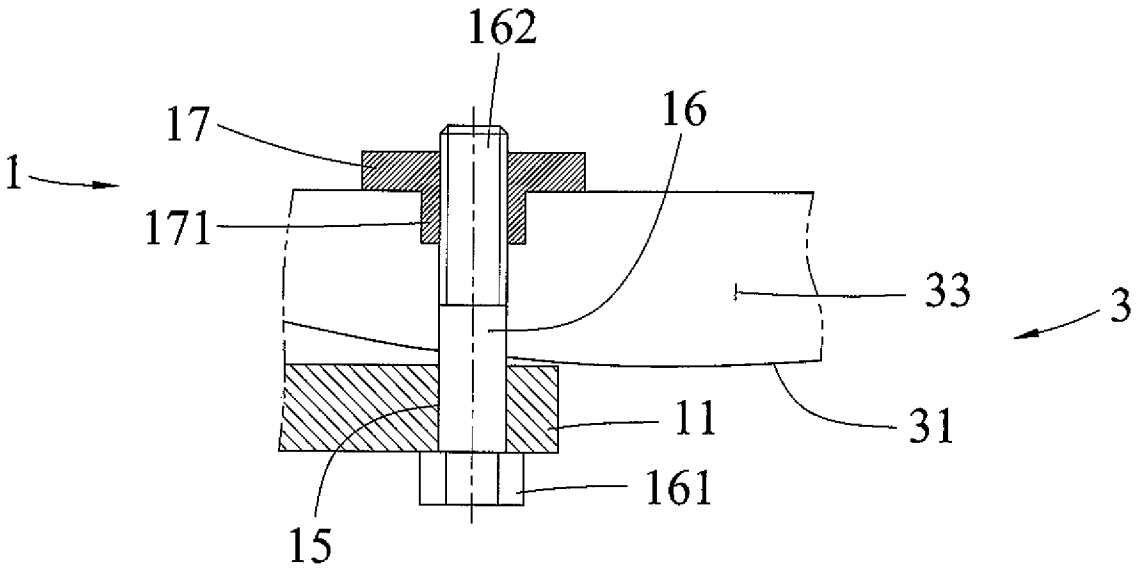
FIG. 5 is another cross sectional view showing the assembly of a part of the vehicle wheel with the self-rescue apparatus according to the first embodiment of the present invention.
Figure 6:
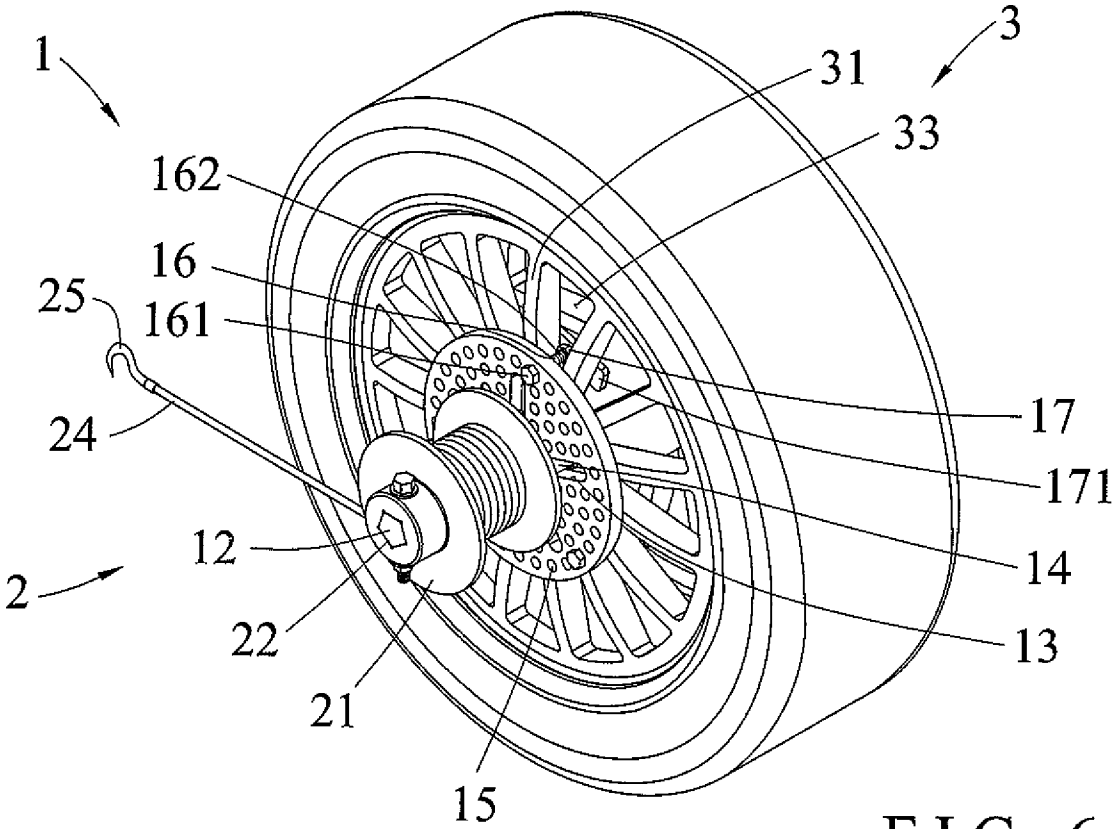
FIG. 6 is a perspective view showing the operation of the vehicle wheel with the self-rescue apparatus according to the first embodiment of the present invention.

Referring to FIGS. 1 and 2, when the tire 3 is trapped in muds, sands, or a cave, and five nuts 32 of the tire 3 protrude out of the wheel rim 31, two of the plurality of fitting sleeves 14 fit with two of the fives nuts 32. As shown in FIGS. 1 and 3, two of the plurality of elongated locking orifices 13 retain with the two fitting sleeves 14 so that the body 11 is fixed on the wheel rim 31 by using the two fitting sleeves 14, and the body 11 resists against a rotation force of the wheel rim 31 to avoid an idle rotation of the body 11. As illustrated in FIGS. 4 and 5, the each connection stem 16 freely inserts through the one of the plurality of through orifices 15 so that the each connection stem 16 inserts through the one through orifice 15, the threaded section 162 of the each connection stem 16 screws with the screwing orifice 171 on the fixing plate 17, and the fixing plate 17 retains with one of plural apertures 33 on the first side of the wheel rim 31, hence the body 11 contacts with the first side of the wheel rim 31 to avoid a removal of the body 11. Accordingly, the body 11 is fixed by ways of the each elongated locking orifice 13 and the each through orifice 15. With reference to FIGS. 1 and 6, the protruded column 12 of the body 11 inserts into the accommodating opening 22 of the rolling disc 21, the lock element 231 inserts through the passing opening 23, the pore 121 and the accommodating opening 22 so as to fix the winch device 2 and the connecting disc 1 together on the wheel rim 23. The rolling disc 21 further has the cable 24 rolled thereon, and the cable 24 has the hooking portion 25 arranged thereon. Thereafter, the hooking portion 22 of the cable 24 is mounted on a trunk, an electric pole, or soils, and when the tire 3 rotates, it drives the body 11 and the rolling disc 21 to rotate, such that the cable 24 is rolled on the rolling disc 21 to pull the tire 3 out of the muds, sands, or cave.

The fixing plate 17 has an anti-slip face formed on one side thereof opposite to a second side of the wheel rim 31, such that the fixing plate 17 retains with the one aperture 33 on the first side of the wheel rim 31, thus mounting the fixing plate 17 securely.

A profile of the inner wall of the one fitting sleeve 14 corresponds to an outer wall of each nut 32 so that the body 11 is fixed on the first side of the wheel rim 31 by using the each fitting sleeve 14.

Figure 8:
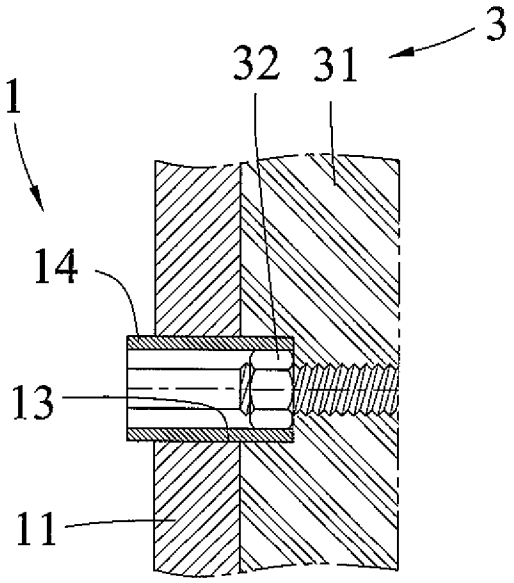
FIG. 8 is a cross sectional view showing the assembly of a part of the vehicle wheel with the self-rescue apparatus according to the second embodiment of the present invention.
Figure 7:
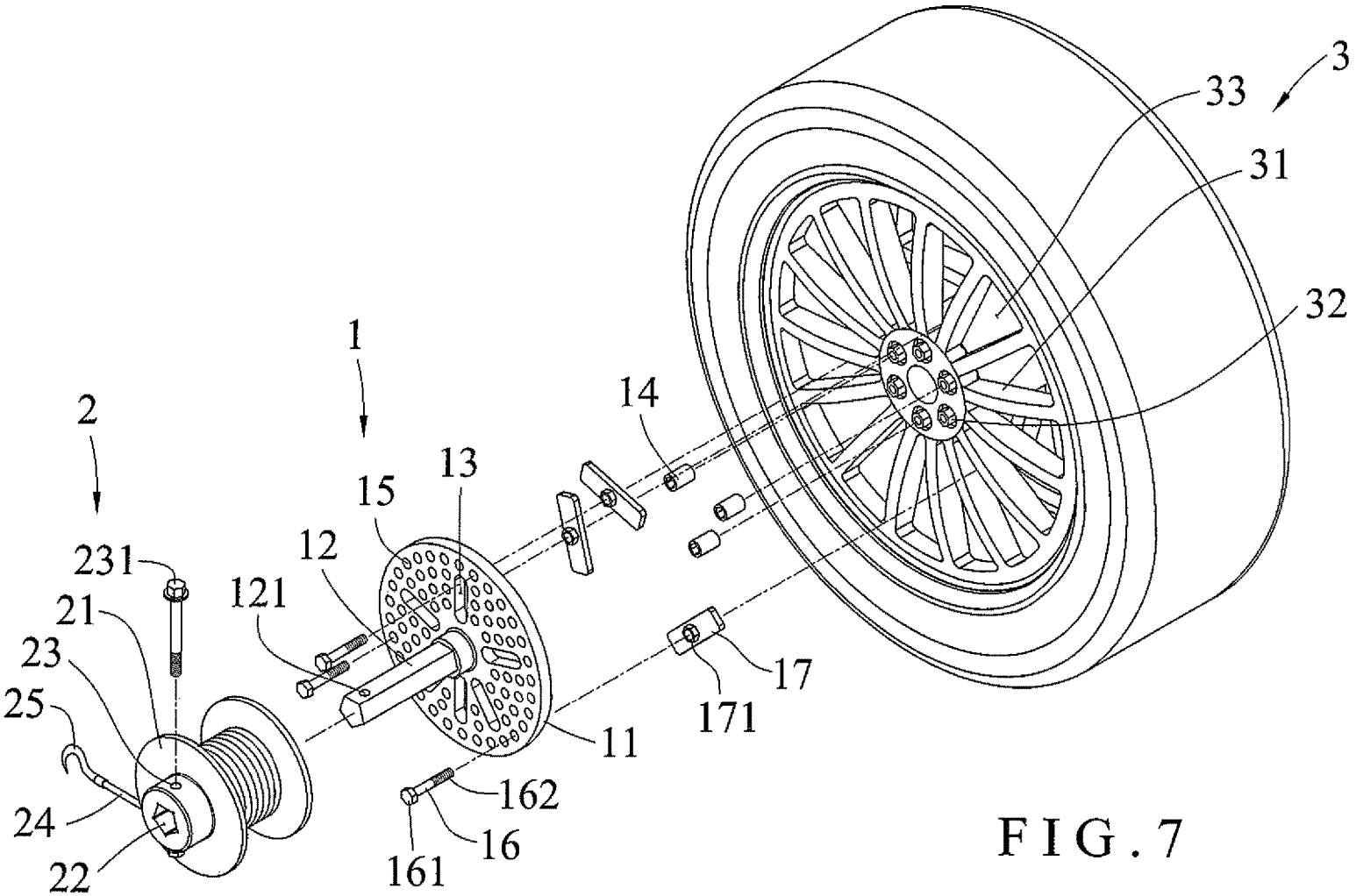
FIG. 7 is a perspective view showing the exploded components of a vehicle wheel with a self-rescue apparatus according to a second embodiment of the present invention.
Figure 9:
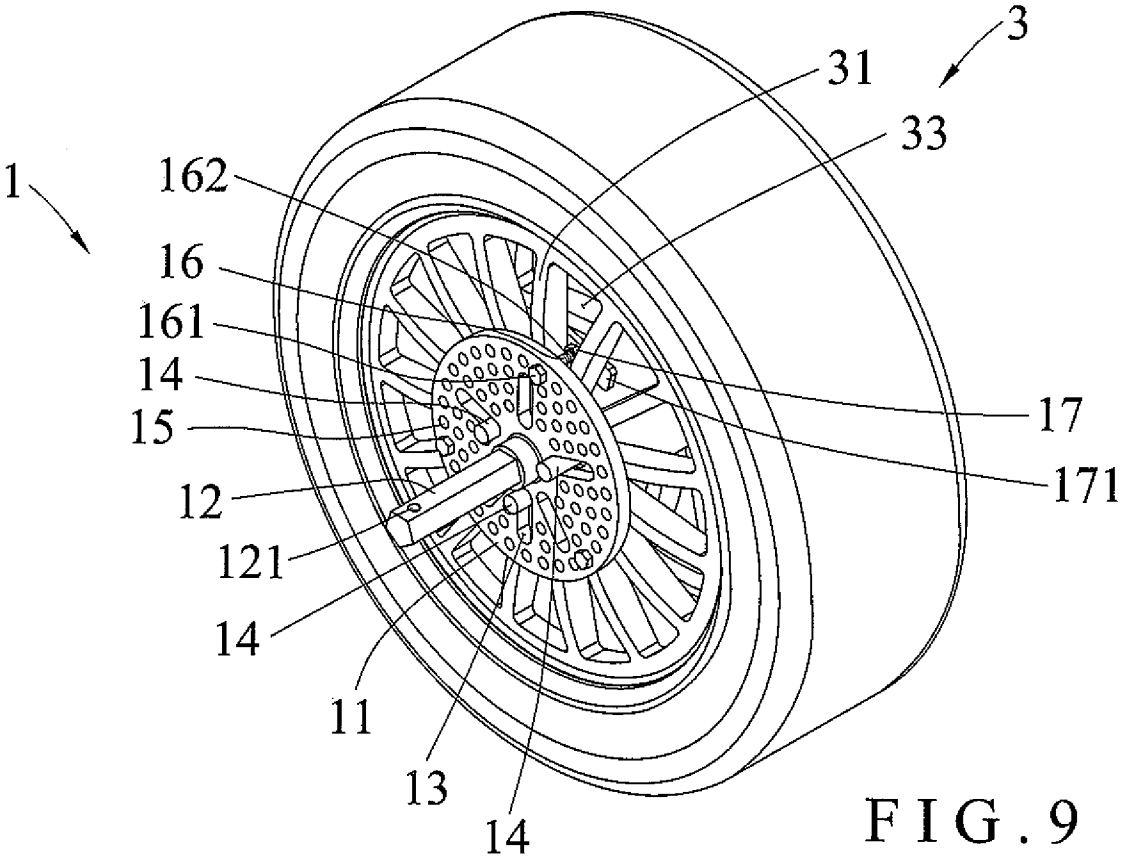
FIG. 9 is a perspective view showing the operation of the vehicle wheel with the self-rescue apparatus according to the second embodiment of the present invention.

With reference to FIG. 7, a difference of a vehicle wheel with a self-rescue apparatus of a second embodiment from that of the first embodiment comprises: six nuts 32 which do not protrude out of a wheel rim 31; wherein three fitting sleeves 14 are fitted with three of the six nuts 32. As shown in FIGS. 8 and 9, three elongated locking orifices 13 retain with the three fitting sleeves 14, and each of a plurality of connection stems 16 is selectively inserted through one of a plurality of through orifices 15, such that the body 11 is fixed on a first side of the wheel rim 31.

Accordingly, the body 11 is fixed on the first side of the wheel rim 31 securely by ways of the plurality of elongated locking orifices 13, the plurality of fitting sleeves 14, the plurality of nuts 32, the plurality of through orifices 15, the plurality of connection stems 16, and the fixing plate 17.

While the preferred embodiments of the invention have been set forth for the purpose of disclosure, modifications of the disclosed embodiments of the invention as well as other embodiments thereof may occur to those skilled in the art. The scope of the claims should not be limited by the preferred embodiments set forth in the examples, but should be given the broadest interpretation consistent with the description as a whole.

What is claimed is:

1. A vehicle wheel with a self-rescue apparatus comprising: a connecting disc and a winch device, the connecting disc being mounted on a first side of a wheel rim of a tire and including a body, a protruded column, a plurality of elongated locking orifices, a plurality of fitting sleeves, a plurality of through orifices, a plurality of connection stems, and multiple fixing plates;

wherein the body has the protruded column extending outwardly from a central position thereof and formed in a polygon shape, the protruded column is inserted into an accommodating hole of the winch device, the plurality of elongated locking orifices are radially arranged on the body to lock with a plurality of nuts on the first side of the wheel rim, wherein each of the plurality of elongated locking orifices fits with one of the plurality of fitting sleeves, an outer wall of the one fitting sleeve retains with an inner wall of each elongated locking orifice, and an inner wall of the one fitting sleeve connects with each of the plurality of nuts on the first side of the wheel rim, such that the body is fixed on the first side of the wheel rim, the body has the plurality of through orifices annularly arranged thereon to insert the plurality of connection stems, and each connection stem has a tab formed on a first end thereof and has a threaded section surrounding a second end thereof so as to screw with a screwing orifice on each of the multiple fixing plates via one of the plurality of through orifices, and each fixing plate contacts with the wheel rim, after the threaded section of each connection stem screws with the screwing orifice of each fixing plate via the one through orifice;

wherein the winch device includes a rolling disc, the accommodating opening, a passing opening, a cable, and a hooking portion; the rolling disc has the accommodating opening passing through a central positioning thereof, wherein a profile of the accommodating opening corresponds to the protruded column, and the rolling disc has the cable rolled thereon, the cable has the hooking portion arranged thereon.

2. The vehicle wheel with the self-rescue apparatus as claimed in claim 1, wherein a profile of the inner wall of the one fitting sleeve corresponds to an outer wall of each nut.

3. The vehicle wheel with the self-rescue apparatus as claimed in claim 1, wherein each fixing plate has a contacting face formed on one side thereof opposite to a second side of the wheel rim.

4. The vehicle wheel with the self-rescue apparatus as claimed in claim 1, wherein the protruded column has a pore defined thereon.

5. The vehicle wheel with the self-rescue apparatus as claimed in claim 4, wherein the rolling disc further has the passing opening configured to accommodate a lock element and communicating with the pore and the accommodating opening.

6. The vehicle wheel with the self-rescue apparatus as claimed in claim 1, wherein the cable is made of steel.

* * * * *